United States Patent [19]

Zalewski

[11] Patent Number: 4,813,384

[45] Date of Patent: Mar. 21, 1989

[54] SOOT BLOWER LANCE WITH CERAMIC COATING

[75] Inventor: Gerald F. Zalewski, Lawrenceville, Ga.

[73] Assignee: White Consolidated Industries, Inc., Cleveland, Ohio

[21] Appl. No.: 182,947

[22] Filed: Apr. 18, 1988

[51] Int. Cl.[4] ..... F22B 37/18; F22B 37/48

[52] U.S. Cl. ..... 122/379; 15/316 R; 122/382; 122/390; 122/392; 122/DIG. 13; 165/95

[58] Field of Search ..... 122/DIG. 13, 379, 390, 122/391, 392, 382; 239/DIG. 13; 165/133, 95; 15/316 R, 317

[56] References Cited

U.S. PATENT DOCUMENTS 3,089,468 5/1963 Clark ..... 122/392

4,658,761 4/1987 Duggan ..... 122/DIG. 13

*Primary Examiner*—Edward G. Favors

*Attorney, Agent, or Firm*—Pearne, Gordon, McCoy & Granger

[57] ABSTRACT

A soot blower lance for power generation boilers and the like, particularly for high temperature operation, in locations exposed to radiant heat. The lance is of multi-section tubular construction, with high temperature alloys used in the sections exposed to maximum temperatures. The lance is provided with a thin outer coating of ceramic, such as fused silica and zirconia. Significantly extended operating life is realized, along with significant energy savings from reduced usage of cleaning fluids for cooling purposes.

10 Claims, 1 Drawing Sheet

SOOT BLOWER LANCE WITH CERAMIC COATING

BACKGROUND AND SUMMARY OF THE INVENTION

The invention is directed to rotary, longitudinally extendable and retractable soot blower lances for cleaning interior surfaces of high temperature boilers, such as used in power generation, for example, particularly for use in areas of boilers that are exposed to high levels of radiant heat.

In the operation of large fossil fuel boilers, especially coal boilers, accumulations of slag and soot form on the walls and on the tube structures on the inside of the boilers, tending gradually to reduce the efficiency of heat transfer within the boiler system. To minimize the effect of these slag and soot accumulations, large boilers typically are provided with a plurality of appropriately located soot blower units. These soot blower units can be of a rotary retracting type, each including an elongated, rotary tubular lance provided at its outer end with nozzles or the discharge of water or, more typically, steam or air.

During the soot blowing operation, as the lance is projected into and then retracted from the interior of the boiler, it is of course subjected to the extremely high temperatures prevailing within the boiler. In those areas of the boiler in which the lance is exposed directly to the flame, it is subjected to not only the convection heat of the hot gases but also (and more significantly) radiant heat from the fire area. As a result, the operating life of a soot blower lance exposed to radiant heat tends to be relatively short. The life of the lance may be extended in some measure by forcing through the lance excess amounts of the cleaning fluid, in order to provide a degree of additional cooling for the exposed lance. While this is somewhat helpful in extending the life of the lance, it of course involves offsetting expenses from the excess consumption of steam, air or other cooling medium.

In accordance with the present invention, the operating life of certain types of lances, namely lances constructed in the first instance of high temperature steels and intended for use in radiant heat areas of a boiler (hereinafter referred to as "high temperature lances"), can be significantly extended by producing a thin coating of ceramic material about the exterior surface of the lance. A relatively thin coating of such ceramic material greatly reduces the rate of heat absorption of the lance material, especially the absorption of radiation heat, which is the most significant source of heat input to the lance.

High temperature steam lances utilizing the principals of the invention can be operated with up to 15–30% less steam flow, while at the same time enjoying a significantly increased operating life.

For a more complete understanding of the above and other features and advantages of the invention, reference should be made to the following detailed description of a preferred embodiment of the invention and to the accompanying drawing.

DESCRIPTION OF PREFERRED EMBODIMENT

Figure 1:
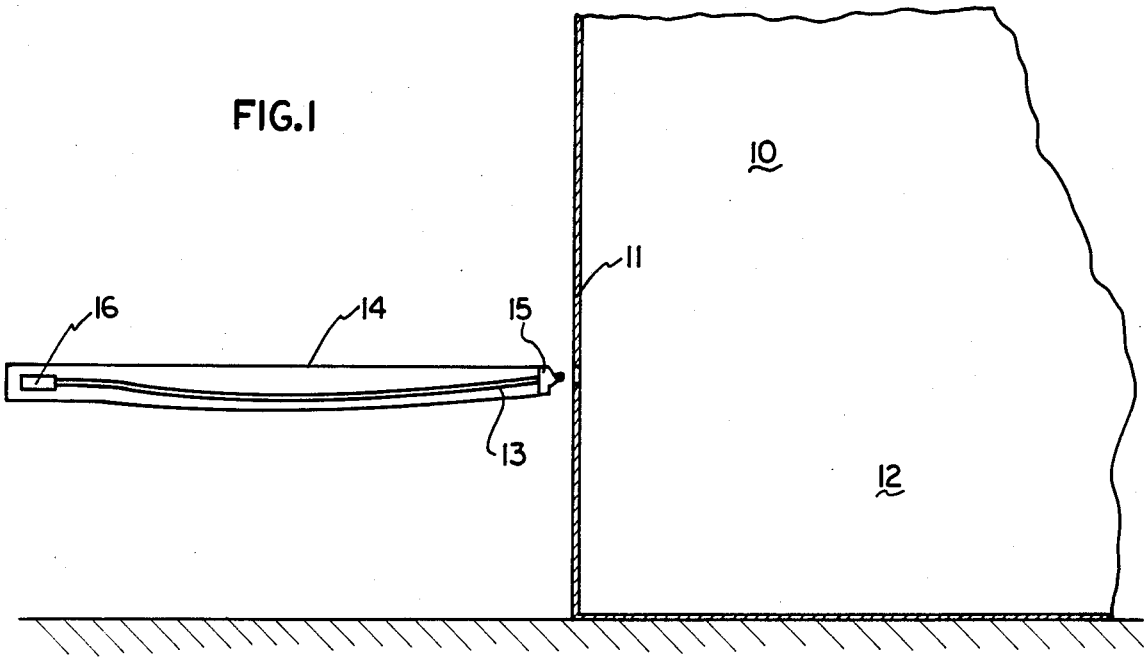
FIG. 1 is a simplified representational side elevation view of a typical long retracting soot blower lance mechanism, shown in its retracted position outside the wall of a boiler firebox.

Referring now to the drawing, and initially to FIG. 1 thereof, there is illustrated, in a simplified representation, a soot blower installation 10 mounted by support structure (not shown) adjacent the wall 11 of a boiler firebox 12. The general structure of the soot blower installation can be of a known type, and reference may be made to the previously-issued U.S. Pat. No. 4,498,213, owned by White Consolidated Industries Inc., for additional details. The disclosure of that patent is hereby incorporated by reference. For the purposes of this invention, the location of the lance on the boiler is such that when the lance is extended into the boiler, it is exposed to direct radiant heat from the fire area 12, in addition to the convection heat of the hot gases flowing at high velocity.

The soot blower mechanism includes an elongated, tubular lance 13 of a length and diameter appropriate to the particular boiler installation. In a typical case, for a large power generation boiler, for example, the lance may be on the order of 50 to 60 feet in length, with an outside diameter of approximately five inches. In accordance with known practices, a high temperature lance 13 usually is of segmented construction, having a relatively thin wall section at its outer end portions, with successive segments being of increasing wall thickness toward the inner (left, as viewed in FIG. 1) end of the lance. The individual segments typically are of a constant outside diameter, and are joined together by welding.

A rigid support structure 14 is provided for the lance and its related mechanisms. At its forward end, the support structure is provided with a rotatable bearing unit 15, which supports the lance immediately adjacent the boiler wall 11. The bearing 15 desirably is rotatable, so as to rotate with the lance 13, and has rollers (not shown) engaging the lance to allow relatively friction-free extending and retracting movements of the lance. A carriage mechanism 16 is supported and guided by the main support beam 14 for movement along the length of the beam, by means of a cable drive or the like (not shown). The carriage 16 engages and supports the rearward end of the lance tube 16 and is arranged to advance and retract the lance tube as well as to rotate it.

Pursuant to known construction techniques, a supply tube (not shown), for steam or other cleaning fluid, extends into the rearward end of the lance tube 13 and forwardly therein, such that the lance and the supply tube are telescopically connected in sealed relation in any position of the lance tube.

In a typical operation of the lance mechanism thus described, a cleaning operation is commenced by actuating the carriage 16 to commence rotation of the lance along with forward or extending movement thereof. The forward extremity of the lance is thus projected into the boiler above the firebox 12, and advances progressively into the boiler while being constantly rotated. As soon as the forward extremity of the lance enters the firebox, the steam or other cleaning fluid is ejected at high velocity from one or more nozzles at the outer or forward end of the lance tube. The number and configuration of such nozzles is a custom function of the particular cleaning job to be performed by that lance (e.g., walls, boiler tubes, etc.).

As the lance tube is projected into the boiler, it is of course exposed to the internal conditions thereof, which may involve the high velocity flow of gases at temperatures on the order of 3000 degrees F., for example, and usually not less than about 2400 degrees F. In addition, and of greater significance, lance tubes exposed to the firebox area receive direct radiation of heat from the free area, in amounts even greater than the heat of convection from the flow of gases. In order to avoid destruction of the lance during this period of exposure, it has been customary practice to maintain the flow of steam or other cleaning fluid at such a level that the fluid, in addition to performing it cleansing function, serves as a coolant for the lance, maintaining the lance at an acceptable operating temperature, for example, not to exceed about 1600 degrees Fahrenheit for a lance constructed of high temperature steel alloys. Quite typically, this involves flow rates which are significantly in excess of those needed for the cleaning operation itself and therefore quite wasteful of energy.

Figure 2:
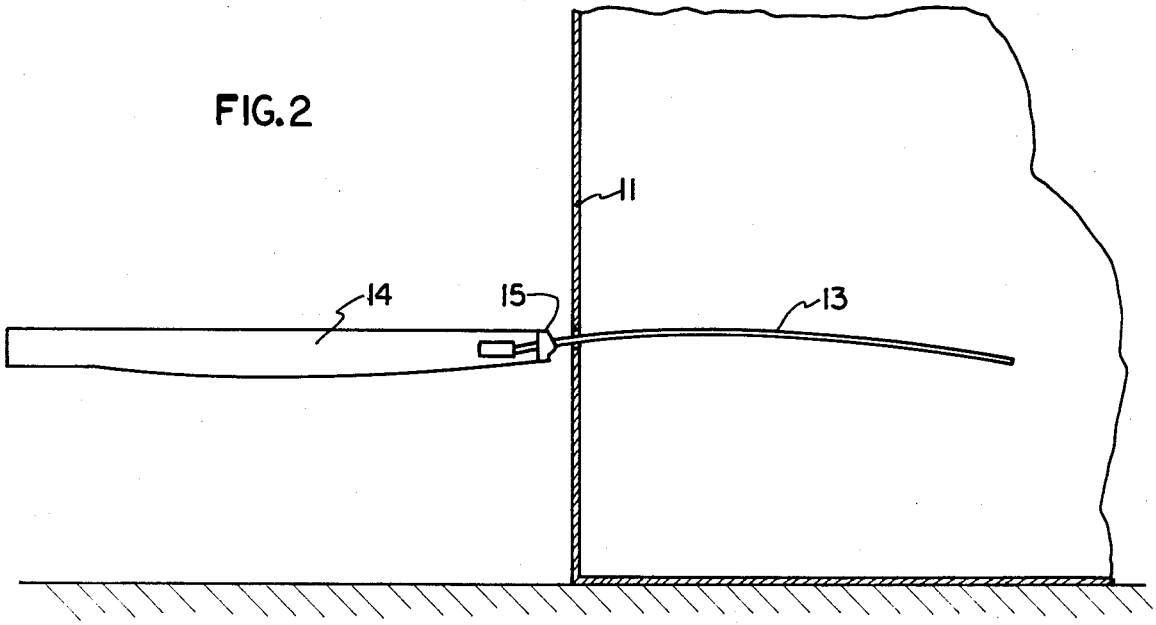
FIG. 2 is a simplified elevational view of the soot blower mechanism of FIG. 1, showing the lance in its fully extended position, projected into the boiler firebox for a cleaning operation.
Figure 3:
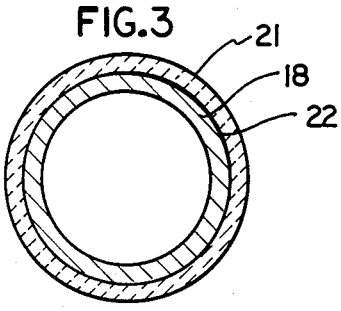
FIG. 3 is an elevational view of a typical high temperature soot blower tubular lance according to invention.
Figure 4:
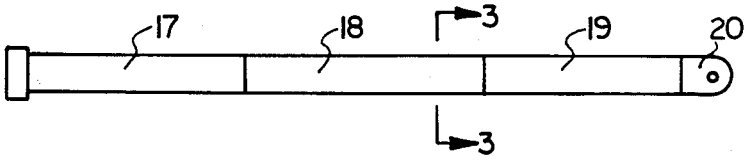
FIG. 4 is a cross-sectional view as taken on line 4—4 of FIG. 3.

As the lance is projected farther and farther into the boiler 11, it becomes a rotating cantilever element, subject to significant deflection at its outer end, as reflected in FIG. 2 of the drawing. After reaching its forward extremity, the lance, while still being continually rotated, is progressively retracted and eventually fully withdrawn from the boiler.

Because of the severe conditions to which high temperature soot blower lances are exposed, it has been necessary to construct such lances of so-called high temperature alloys. In view of the high cost of such alloys, it has been conventional to construct high temperature lances in segmental fashion. For a 50–60 foot lance, for example, a typical lance would be constructed of inner, intermediate, and outer segments 17–19, together with a nozzle tip 20. The inner most segment 17, which is subject to less severe temperature conditions than the outer segments, advantageously is formed of Timken alloy 17-22AS, available from the Timken Company. This alloy, while relatively inexpensive, retains its strength well up to temperatures of about 1000 degrees F. Principal alloying ingredients of the Timeken alloy are approximately 1.5% chromium and approximately 0.5% molybdenum. The intermediate and outer sections 18, 19 are advantageously constructed of 316 stainless steel and 321 stainless steel respectively. These are both high-chrome, high-nickel content stainless steels which exhibit excellent strength characteristics at the higher temperatures to which these outer sections are exposed. 316 stainless steel typically includes 16–18% chromium, 10-14% nickel, whereas the 321 stainless steel includes approximately 17–19% chromium and approximately 9–12% nickel. Another high-chromium alloy, Incoloy 800 HT, may also be used for one of the outer sections. These specified alloys are not intended to be limiting, as will be understood.

In a typical lance of the type suitable for use in connection with the practice of the invention, the innermost tubular segment 17 may have a length of about 25 feet and may be formed with a wall thickness of approximately ½ inch. A second segment 18, formed of 316 stainless, may have a length of about 15 feet and wall thickness of about ⅜ of an inch. The outer segment 19, which may be 10–20 feet in length, is formed of 321 stainless and desirably has a wall thickness of 3/16 of an inch.

The segmented construction of the high temperature lance is desirable in order to minimize the utilization of higher cost alloys. Additionally, it accommodates the use of wall thicknesses consistent with the stress placed upon the section.

As will be readily appreciated, a high temperature lance is very expensive to manufacture, because of its segmented construction and because of the required use of high temperature alloys. Notwithstanding the use of such high temperature alloys, however, high temperature lances typically have a relatively short operating life under normal usage because of the extreme conditions to which they are exposed. A typical operating life for such a lance may be on the order of one year, for example.

Our investigations have indicated that a lance exposed to the firebox area of a typical large-scale boiler, is subject to heat from two primary sources: (1) forced convection, resulting from the relatively high velocity flow of hot gases over the lance, and (2) from radiation received from hot surfaces and hot bodies to which the lance is exposed. A useful calculation for heat absorption rate to a soot blower lance under such conditions is the following:

$$q/a = hg(Tg - Tw) + Eb \times El \times o(Tg^4 - Tw^4),$$

where hg equals the gas film coefficient,
Tg equals gas temperature of the boiler,
Tw equals the lance wall temperature,
Eb equals the emittence of the boiler,
El equals the emittence of the lance, and
o equals the electrical conductivity or Stefan = Baltzman constant For a typical, conventionally constructed lance of high temperature alloy, assuming conditions of Tg equals 3000 degrees F., Tw equals 1000 degrees F., Eb equals 0.8, El equals 0.5, the calculated heat absorption rate per unit of lance area approximates 17,600 BTU per square foot of area from forced convection plus approximately 95,100 BTU per square foot from radiation, or a total of about 112,700 BTU per hour per square foot from both sources.

In accordance with the present invention, this heat absorption rate may be significantly reduced by providing on the exterior surface of the lance a thin ceramic barrier coat 21. Such a coating, it has been discovered, generally reduces the rate of heat absorption from radiant sources—the most significant source of heat in the firebox area. An advantageous composition may comprise, among other things, zirconium oxide, magnesium zirconate, yittrium stabilized zirconate, or fused silica and zirconia. Most preferably, for a lance constructed of high temperature alloys, as described, and a diameter on the order of five inches, the ceramic coating comprises a fused silica and zirconia, sprayed onto the outer surface of the lance at a thickness on the order of 0.015 to 0.020 inch. The spraying procedure advantageously may be performed by Plasma Fusions, Inc., of Grosse Isle, MI. The particular spraying process for ceramic material is known and does not form part of the present invention.

Pursuant to the invention, the outer surface of the lance is prepared for receiving the ceramic coating by said blasting, to achieve a degree of surface roughness. Thereafter, the surface advantageously is plasma coated with nichrome, to provide an optimum bonding interface between the base alloy materials of the lance and the external ceramic coating. The ceramic material, in a molten condition, is atomized and projected at high velocity onto the roughened and primed surface, using compressed air as a carrier.

To advantage, the sprayed ceramic barrier coating need not be independently cured, but is cured in situ, after installation of the coated lance on the boiler. In this respect, after the lance is installed in its support structure, and then inserted into the boiler in an otherwise normal soot blowing operation, its exposure to the high internal temperature of the firebox serves to fully cure the ceramic barrier coating.

The presence of a thin, ceramic barrier coating as described, significantly reduces the emittence value of the lance, i.e., from about 0.5 to about 0.28. As a result, the heat absorption rate of the lance, from radiation sources, under the conditions referred to above, may be reduced dramatically, from approximately 95,100 BTU per hour per square foot to about 53,250 BTU per hour per square foot, reducing the total heat absorption rate of the lance from about 112,700 BTU per hour per square foot to approximately 71,000 BTU per hour per square foot.

As a result of the provision of the ceramic barrier coat, the midwall temperature of the lance, where exposed to the radiant heat of the interior of the firebox, is greatly reduced, enabling the lance materials to be operated under significantly less severe conditions. Among other advantages, the excess flow of cleaning fluid, typically steam, utilized for the specific purpose of lance cooling, can be substantially reduced. Meaningful energy savings can be realized from this reduction.

Under typical operating conditions, a ceramic coated high temperature lance will operate significantly cooler than a conventional lance. Midwall temperature calculations of the outermost lance sections 18, 19, under the boiler conditions mentioned above, indicate those sections will have midwall temperatures of approximately 1520° F. in conventionally constructed, high temperature lance without the ceramic barrier coating of the invention. The same lance under the same conditions, but using the ceramic barrier coating of the invention, will have lance midwall temperatures for the same sections of approximately 1170° F. These dramatically reduced wall temperatures, not only allow a meaningful reduction in the amount of steam or other cleaning fluid, in excess of cleaning requirements, required to be passed through the lance solely for cooling purposes, but result in important metallurgical advantages as well. For example, the lower temperature operating conditions of the coated lance result in greatly minimizing or eliminating decarburization of the lance material. Lance operative life is also significantly extended by greatly reducing the gradual degradation of the lance material due to progressive loss of alloying elements. Additionally, since the lance tends to operate at a lower temperature, its operating yield strength, for an equivalent lance, is greater, which also contributes to the extended operating life of the lance. By way of example, whereas a conventional high temperature lance may have a typical operating life of one year, an experimental lance installed in a power generation boiler has continued to operate for approximately two years, with indications that the unit may continue to operate for an additional period of time.

As will be appreciated from the illustrations of FIGS. 1 and 2, a long retracting rotary soot blower lance is subjected to considerable bending and deflection both during installation and in service. Particularly during normal service, when the lance is fully extended into the boiler, its cantilever, supported outer end is subjected to substantial deflection while being rotated at a speed of, for example, 6.5 rpm. Accordingly, a ceramic barrier coating on such a lance is subject to considerable stress. In accordance with the invention, the relatively thin ceramic coating, applied in the manner described, is well able to withstand not only the bending stresses to which the lance is subjected, but also the relatively significantly loading, which is imposed upon the lance at the front bearing 15, when the lance is extended well into the boiler and the weight of the free end is supported entirely by the front bearings.

The coated soot blower lance construction of the invention achieves substantial savings in two ways: it dramatically extends the operating life of a costly, multi-alloy high temperature lance. In addition, it enables meaningful reductions to be made in the amount of cleaning fluid passed through the lance solely for cooling purposes.

It should be understood, of course, that specific form of the invention illustrated and described herein is intended to be representative only, as certain variations may be made therein without departing from the clear teachings of the disclosure. Accordingly, reference should be made to the following appended claims in determining the full scope of the invention.

I claim:

1. In a soot blower for cleaning the interior of a boiler and of the type comprising an elongated, tubular lance where the lance is exposed to radiant heat as well as heat of convection, a mounting structure for said lance situated on the exterior of said boiler, carriage means supported by said mounting structure for projecting said lance into said boiler for cleaning operations and subsequently retracting said lance to a position outside of said boiler, means for directing a fluid under pressure through said lance during cleaning operations for cooling of said lance and cleaning of said portions of said boiler, the improvement characterized by (a) said tubular lance comprising a plurality of sections, at least one of which is formed of a high temperature steel alloy, (b) said lance being provided over its exterior portions exposed to radiant heat sources in the interior of said boiler, with a thin layer of ceramic material, (c) the thickness of said layer being substantially less than the wall thickness of said tubular lance.

2. The soot blower improvement of claim 1, further characterized by (a) said high temperature alloy comprising a high-chromium alloy.

3. The soot blower improvement of claim 1, further characterized by (a) said lance being surface roughened and plasma coated with nichrome prior to application of said layer of ceramic material.

4. The soot blower improvement of claim 3, further characterized by (a) said ceramic material comprising fused silica and zirconia.

5. The soot blower improvement of claim 4, further characterized by (a) said ceramic being applied in a coating thickness of from about 0.015 inch to about 0.020 inch.

6. A lance tube for a soot blower intended for installation in a boiler or the like where said lance tube will be exposed to radiant heat and heat of convection at temperature levels of at least about 2400 degrees F., characterized by (a) said lance tube comprising at least two tubular sections secured end to end, (b) at least the outermost section being formed of a high-chromium steel alloy, (c) said lance tube being coated with a ceramic coating of about 0.015 to 0.020 inch in thickness.

7. A lance tube according to claim 6, further characterized by (a) said ceramic coating comprising fused silica and zirconia.

8. A lance tube according to claim 7, further characterized by (a) said coating being in an uncured state when said lance tube is installed in a boiler or the like and cured in situ during operation.

9. A lance tube according to claim 6, further characterized by (a) said lance comprising at least three tubular sections of different alloys and wall thicknesses secured end to end.

(b) at least the outermost two sections being formed by high-chromium alloys.

10. A lance tube according to claim 6, further characterized by (a) said lance tube being rotatable about its axis and supported in cantilever fashion under normal conditions.

* * * * *